US007614889B1

(12) United States Patent
Black et al.

(10) Patent No.: US 7,614,889 B1
(45) Date of Patent: Nov. 10, 2009

(54) UTILITY RECEPTACLE APPARATUS FOR USE WITH A WORK SURFACE OR SIMILAR ARTICLE

(75) Inventors: David Black, Orange, CT (US); Harry Proscino, Hamden, CT (US)

(73) Assignee: Premier Manufacturing Group, Inc., Shelton, CT (US)

( * ) Notice: Subject to any disclaimer, the term of this patent is extended or adjusted under 35 U.S.C. 154(b) by 0 days.

(21) Appl. No.: 12/271,302

(22) Filed: Nov. 14, 2008

Related U.S. Application Data

(60) Provisional application No. 61/100,615, filed on Sep. 26, 2008.

(51) Int. Cl.
*H01R 13/44* (2006.01)

(52) U.S. Cl. ..... 439/142; 174/67; 439/206; 439/538; 439/564

(58) Field of Classification Search ..... 439/142, 439/144, 206, 538, 564; 174/66, 67; 220/242
See application file for complete search history.

(56) References Cited

U.S. PATENT DOCUMENTS

| | | | | | |
|---|---|---|---|---|---|
| 1,909,270 | A | * | 5/1933 | Guett | 439/538 |
| 2,029,716 | A | * | 2/1936 | Hartmann | 439/538 |
| 2,205,051 | A | * | 6/1940 | Schmitt | 439/564 |
| 2,465,079 | A | * | 3/1949 | Fitzgerald | 200/50.07 |
| 2,987,214 | A | * | 6/1961 | Radack | 220/242 |
| 3,083,347 | A | * | 3/1963 | Fahey, Jr. | 439/337 |
| 4,654,756 | A | | 3/1987 | Wilson | |
| 4,871,884 | A | * | 10/1989 | Hayashi | 174/560 |
| 4,952,753 | A | * | 8/1990 | Hayashi et al. | 174/559 |
| 5,230,552 | A | | 7/1993 | Schipper | |
| 5,231,562 | A | | 7/1993 | Pierce | |
| 5,575,668 | A | | 11/1996 | Timmerman | |
| 5,709,156 | A | | 1/1998 | Gevaert | |
| 6,028,267 | A | | 2/2000 | Byrne | |
| 6,290,518 | B1 | | 9/2001 | Byrne | |
| 7,407,392 | B2 | | 8/2008 | Cooke | |

* cited by examiner

*Primary Examiner*—Neil Abrams
(74) *Attorney, Agent, or Firm*—Raymond A. Nuzzo

(57) ABSTRACT

The present invention is directed to a utility receptacle apparatus for use with a work surface. The utility receptacle apparatus has a mounting member that has a frame which has a central opening and a peripheral portion that extends about the central opening. At least one fastening device is attached to the mounting member for attaching the mounting member to a work surface. The utility receptacle apparatus also has a base positioned within the central opening of the frame and attached to the frame. The base has a body portion and a utility receptacle member that is attached to the body portion. The utility receptacle member has a raised face that is above the top surface of the peripheral portion of the frame. At least one utility receptacle is connected to the raised face of the utility receptacle member. The utility receptacle apparatus further includes a hinge device that has first section attached to the base and a second section that pivots with respect to the first section. A cover is attached to the second section of the hinge device and pivots between a closed position and an open position. The cover has front and side portions, an exterior portion and an interior portion. The interior portion comprises a recessed interior surface that confronts the raised face of the utility receptacle member when the cover is in the closed position. The front and side portions and recessed interior surface of the cover cooperate to provide a spatial region within the interior portion of the cover that is sized to receive the entire raised face of the utility receptacle member when the cover is closed.

13 Claims, 14 Drawing Sheets

UTILITY RECEPTACLE APPARATUS FOR USE WITH A WORK SURFACE OR SIMILAR ARTICLE

CROSS-REFERENCE TO RELATED APPLICATIONS

This application claims the benefit of the filing date of U.S. provisional application no. 61/100,615, filed Sep. 26, 2008.

TECHNICAL FIELD

The present invention generally relates to a utility receptacle apparatus that can be used with the work surface of an article of furniture such as a table, desk, workbench, workstation or similar article.

BACKGROUND ART

Utility receptacle apparatuses for use with work surfaces of workbenches, workstations and similar articles of furniture are known in the art and are described in U.S. Pat. Nos. 5,709,156, 5,575,668, and 7,407,392.

DISCLOSURE OF THE INVENTION

The present invention is directed to a utility receptacle apparatus for use with a work surface. The utility receptacle apparatus comprises a mounting member that comprises a frame having a central opening and a peripheral portion that extends about the central opening. At least one fastening device is attached to the mounting member for attaching the mounting member to a work surface. The utility receptacle apparatus includes a base that is positioned within the central opening of the frame and is attached to the frame. The base comprises a body portion and utility receptacle member attached to the body portion. The utility receptacle member has a raised face that is above the upper surface of the peripheral portion of the frame. At least one utility receptacle is connected to the raised face of the utility receptacle member. The utility receptacle apparatus further includes a hinge device that has first section attached to the base and a second section that pivots with respect to the first section. A cover is attached to the second section of the hinge device and pivots between a closed position and an open position. The cover comprises a front portion, a pair of side portions, an exterior portion and an interior portion. The interior portion comprises a recessed interior surface that confronts the raised face of the utility receptacle member when the cover member is in the closed position. The front and side portions of the cover and the recessed interior surface of the cover cooperate to provide a spatial region within the interior portion of the cover that is sized to receive the entire raised face of the utility receptacle member when the cover is in the closed position.

Further features and advantages of the present invention are described in the ensuing description.

DESCRIPTION OF THE DRAWINGS

The present invention will be more readily understandable from a consideration of the accompanying drawings, wherein.

BEST MODE FOR CARRYING OUT THE INVENTION

Figure 8A:
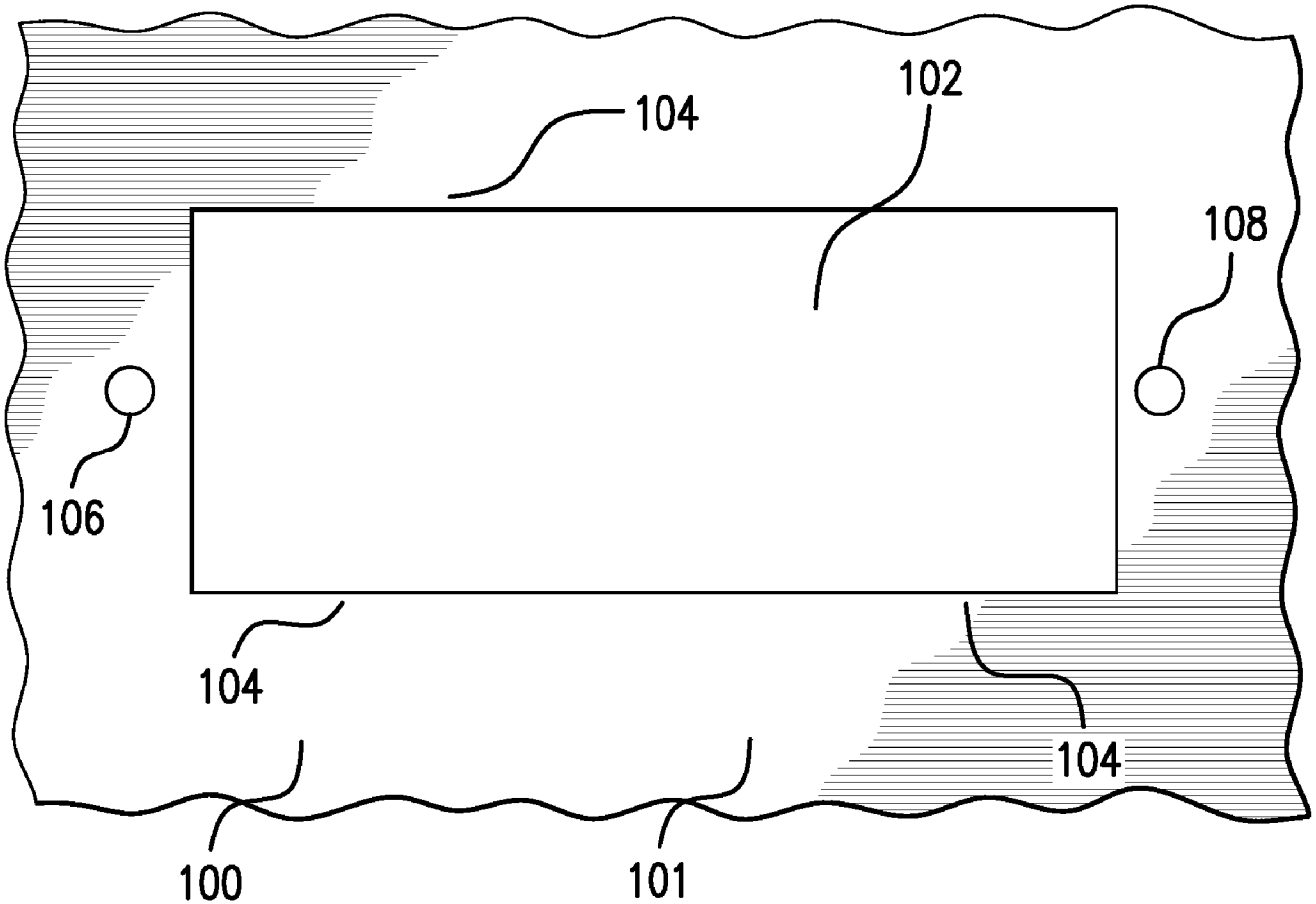
FIG. 8A is a top plan view of an article of furniture having a work surface and an opening in the work surface, the utility receptacle apparatus of FIG. 1 being configured to be mounted to the work surface of the article of furniture.
Figure 8B:
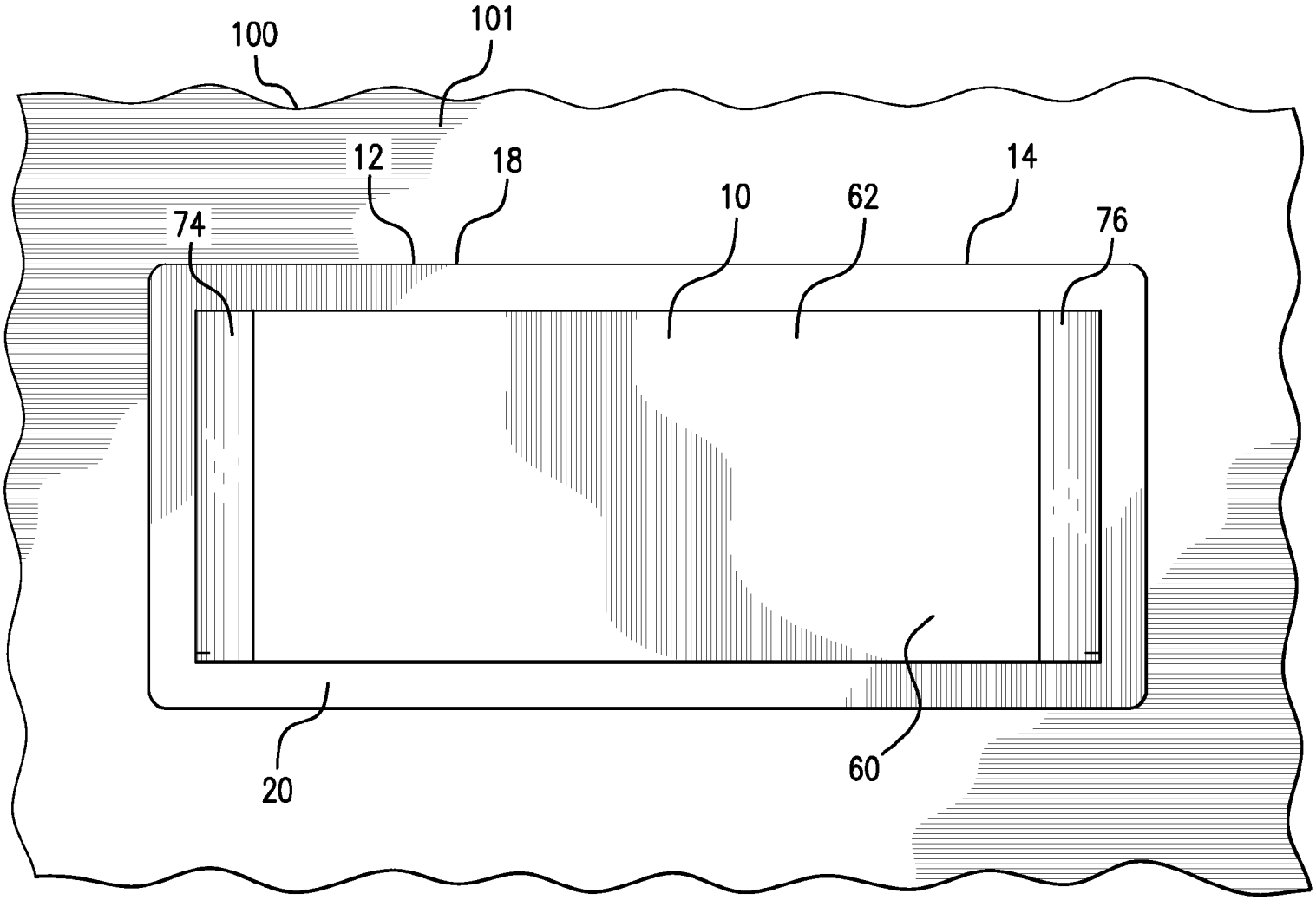
FIG. 8B is a top plan view showing the utility receptacle apparatus of FIG. 1 mounted to the work surface.
Figure 8C:
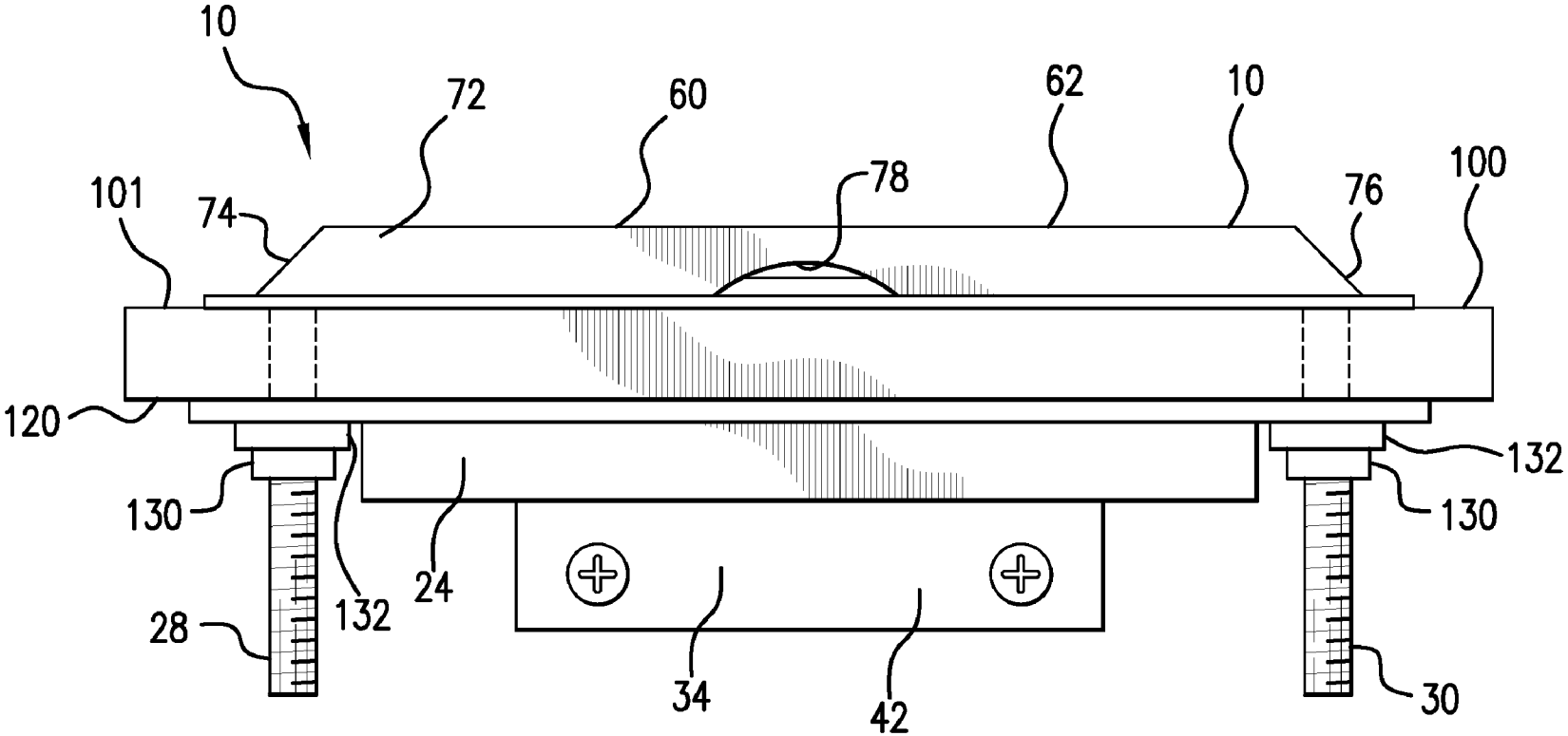
FIG. 8C is a front view, in elevation, showing the utility receptacle apparatus of FIG. 1 mounted to the work surface of the article of furniture.

Referring to FIGS. 1-5, there is shown utility receptacle apparatus 10 in accordance with a preferred embodiment of the present invention. Utility receptacle apparatus 10 comprises mounting member 12 which comprises a frame 14 having a central opening 16, and a peripheral portion 18 extending about the central opening 16. Peripheral portion 18 has upper or top surface 20 and bottom surface 22. Frame 14 has front and rear walls 24 and 26, respectively, which extend downward from peripheral portion 18. Mounting member 12 includes fastening members 28 and 30 that are configured to attach frame 14 to a work surface 101 (see FIGS. 8A, 8B and 8C). In a one embodiment, fastening members 28 and 30 are machine screws that are attached to the bottom surface 22 of peripheral portion 18. Apparatus 10 further comprises a base 34 attached to the mounting member 12 and positioned within the central opening 16 of the frame 14. In a preferred embodiment, base 34 is removably attached to front and rear walls 24 and 26, respectively, of frame 14. The base 34 comprises a utility receptacle member 36 that has a raised face 38 that is above the upper surface 20 of the peripheral portion 18, and a body portion 42 that is attached to and positioned beneath the utility receptacle member 36. In one embodiment, raised face 38 is about 2.5 mm (millimeters) above upper surface 20 of peripheral portion 18. The height of raised face 38 above upper surface 20 is indicated by reference letter H1 in FIG. 4. In a preferred embodiment, the height H1 is between 2.0 and 4.0 mm.

Figure 1:
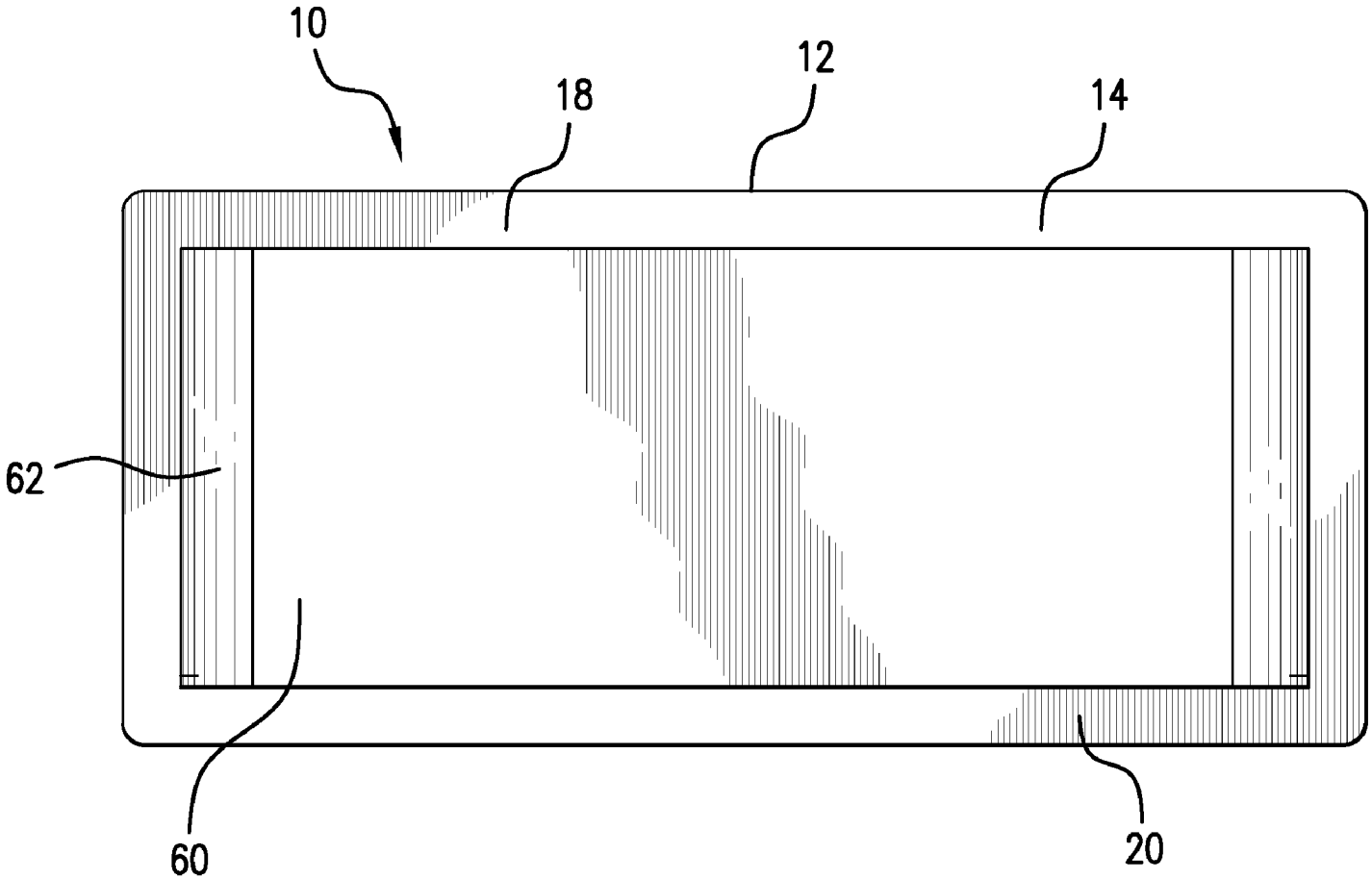
FIG. 1 is a top plan view of a utility receptacle apparatus in accordance with one embodiment of the present invention, the view showing a cover of the utility receptacle apparatus in the closed position.
Figure 2:
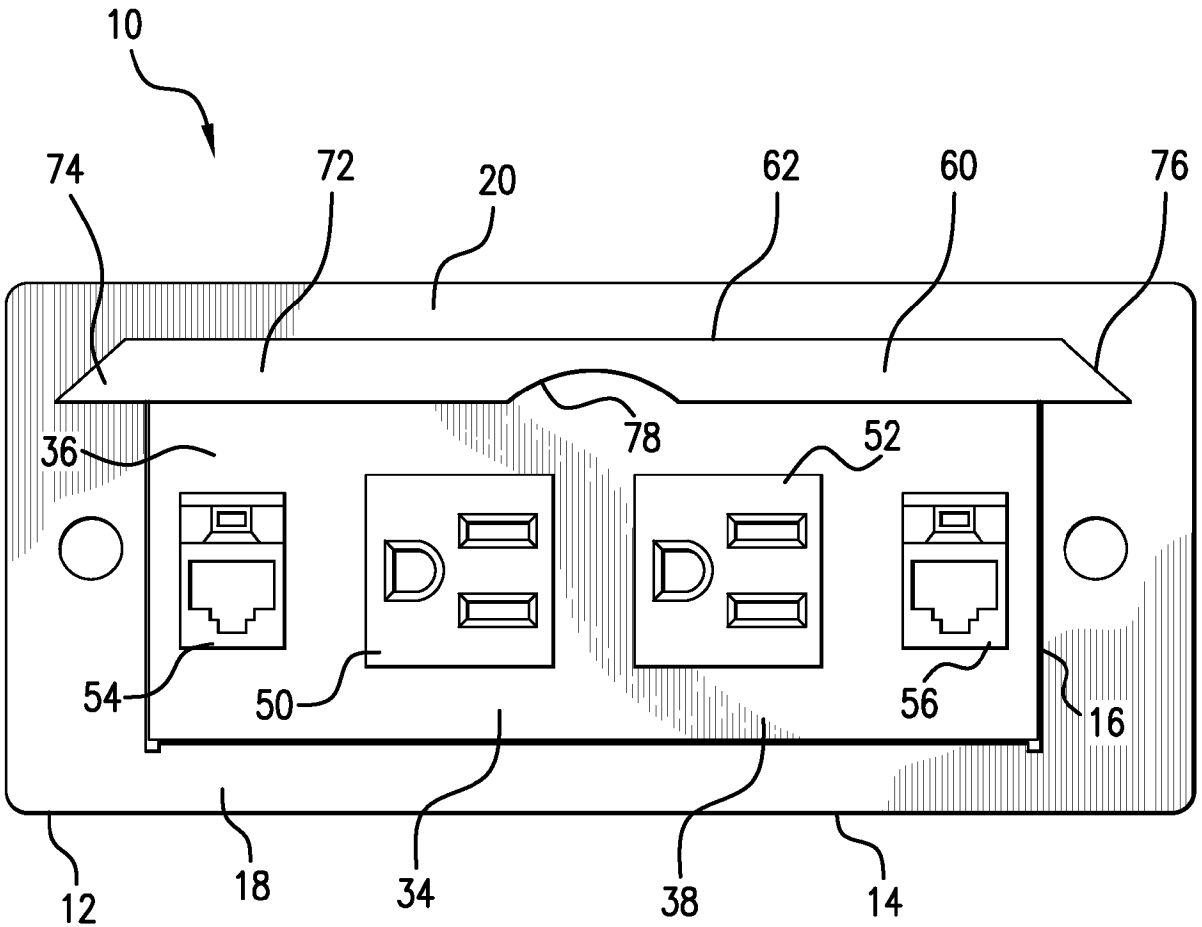
FIG. 2 is top plan view of the utility receptacle apparatus of FIG. 1, the view showing the cover of the utility receptacle apparatus in the open position.
Figure 3:
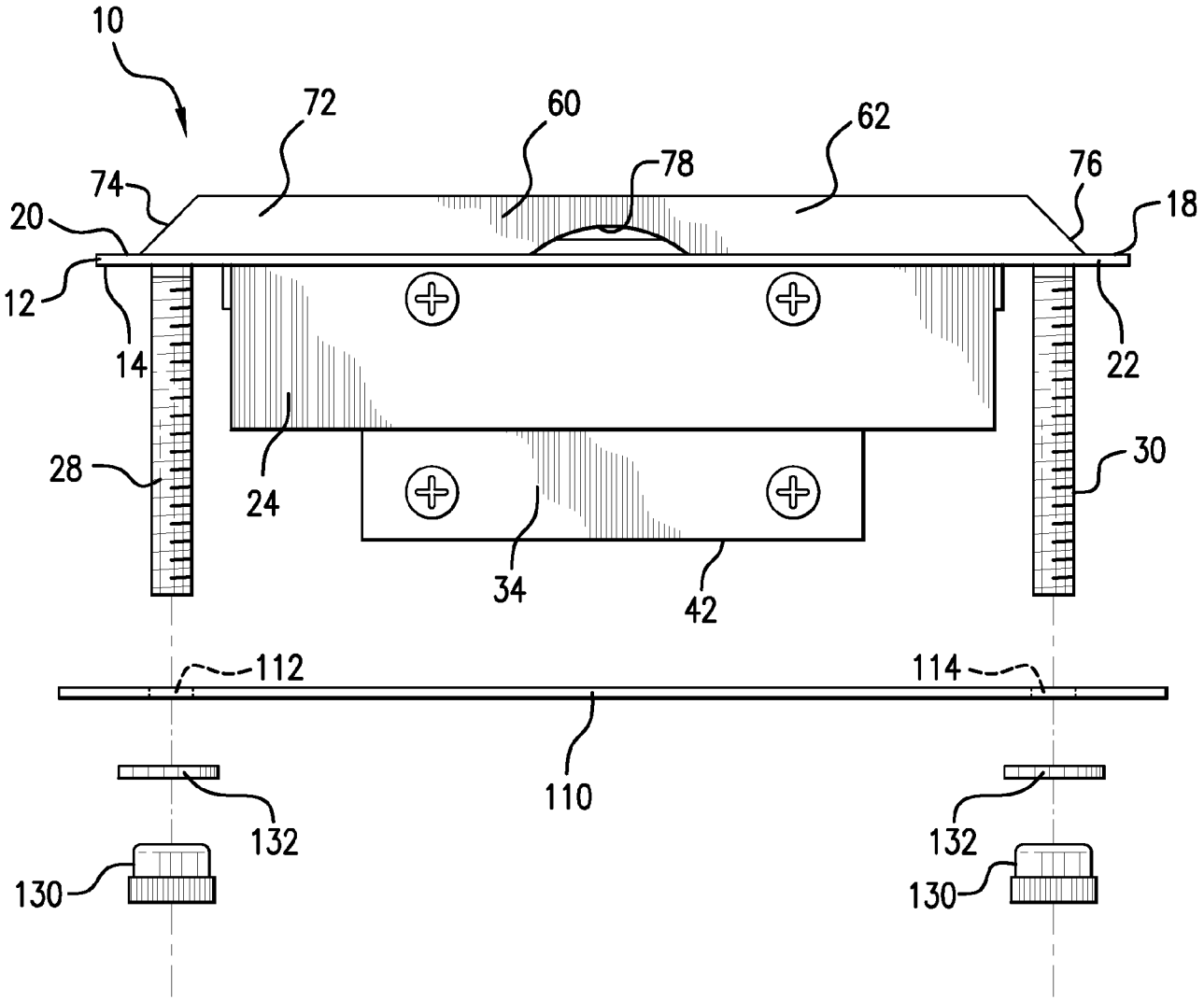
FIG. 3 is a front view of the utility receptacle apparatus of FIG. 1, the view showing the cover in the closed position.
Figure 4:
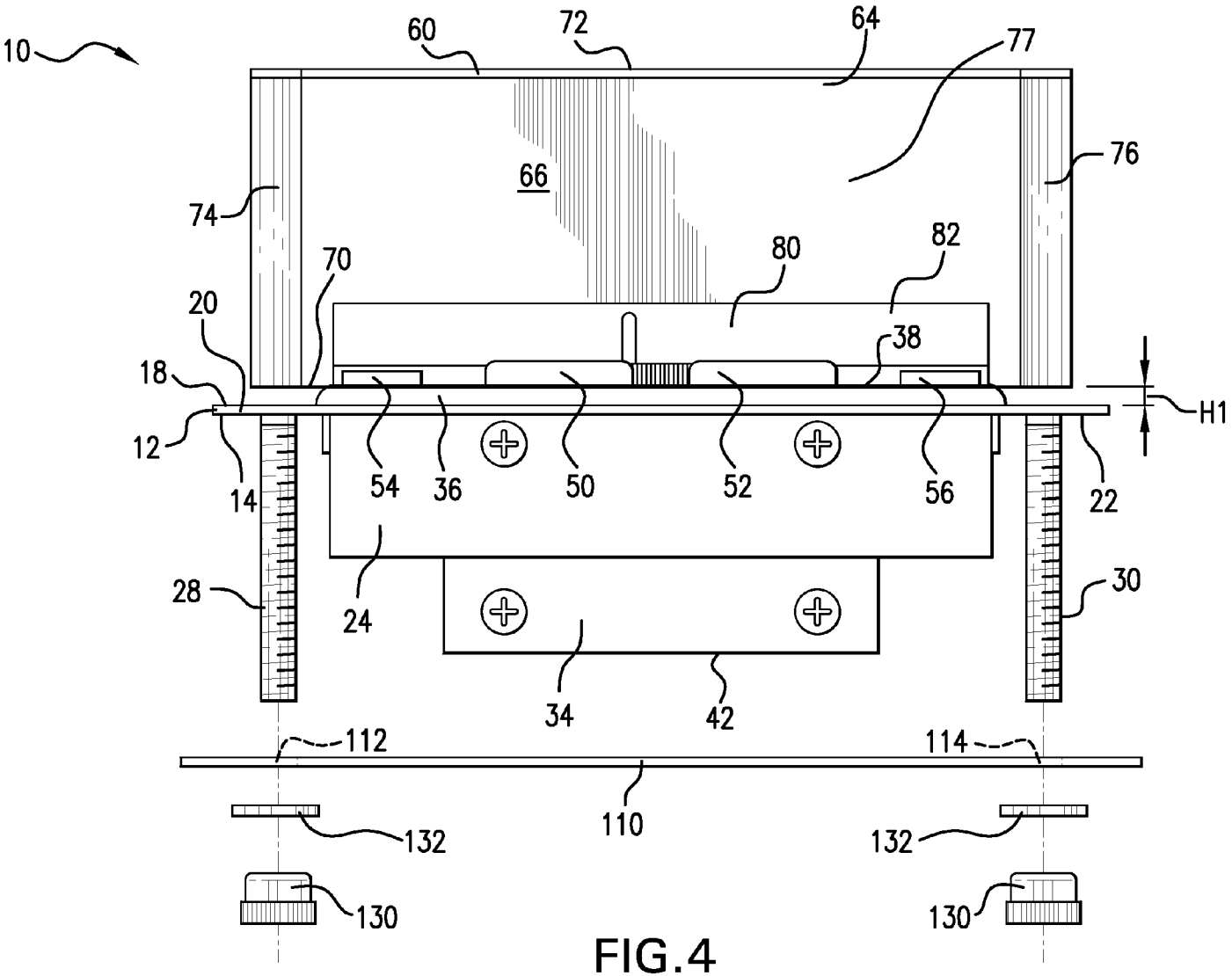
FIG. 4 is a front view of the utility receptacle apparatus of FIG. 1, the view showing the cover in the open position.

Referring to FIG. 2, utility receptacles 50, 52, 54 and 56 are connected to the raised face 38 of the utility receptacle member 36. The purpose of height H1 is to prevent spilled fluids from contacting utility receptacles 50, 52, 54 and 56. Utility receptacles 50 and 52 are configured to provide A.C. voltages (e.g. 117 VAC) to power office or laboratory equipment, e.g. personal computers, oscilloscopes, etc. Wires (not shown) are connected to connectors (not shown) on the rear of utility receptacles 50 and 52 so as to provide electrical power from an electrical power source (not shown). Utility receptacles 54 and 56 are configured as communication receptacles that provide connections to communication networks, e.g. telephone, internet, video, computer, broadband, DSL, etc. Wires (not shown) are connected to connectors (not shown) on the rear of utility receptacles 54 and 56 and the aforesaid communication networks (not shown).

Referring to FIGS. 1, 2, 4 and 6, utility receptacle apparatus 10 further comprises a cover 60 that is pivotally attached to the base 34. Cover 60 is configured to have an exterior portion 62 and an interior portion 64. The interior portion 64 comprises a recessed interior surface 66 that confronts the raised face 38 of the utility receptacle member 36 when the cover 60 is in the closed position. Cover 60 has a rear edge 70, a front lengthwise end portion 72, and a pair of widthwise end portions 74 and 76. Each widthwise end portion 74 and 76 is bevelled. Front lengthwise end portion 72 is substantially perpendicular to recessed interior surface 66. Bevelled widthwise end portions 74 and 76, and front lengthwise end portion 72 cooperate to form a spatial region 77 that is sized for receiving the raised face 38 of utility receptacle member 36 when cover 60 is closed. Cover 60 has a notch or cut-out 78 in front lengthwise end portion 72 to enable a user to lift cover 60.

Figure 5:
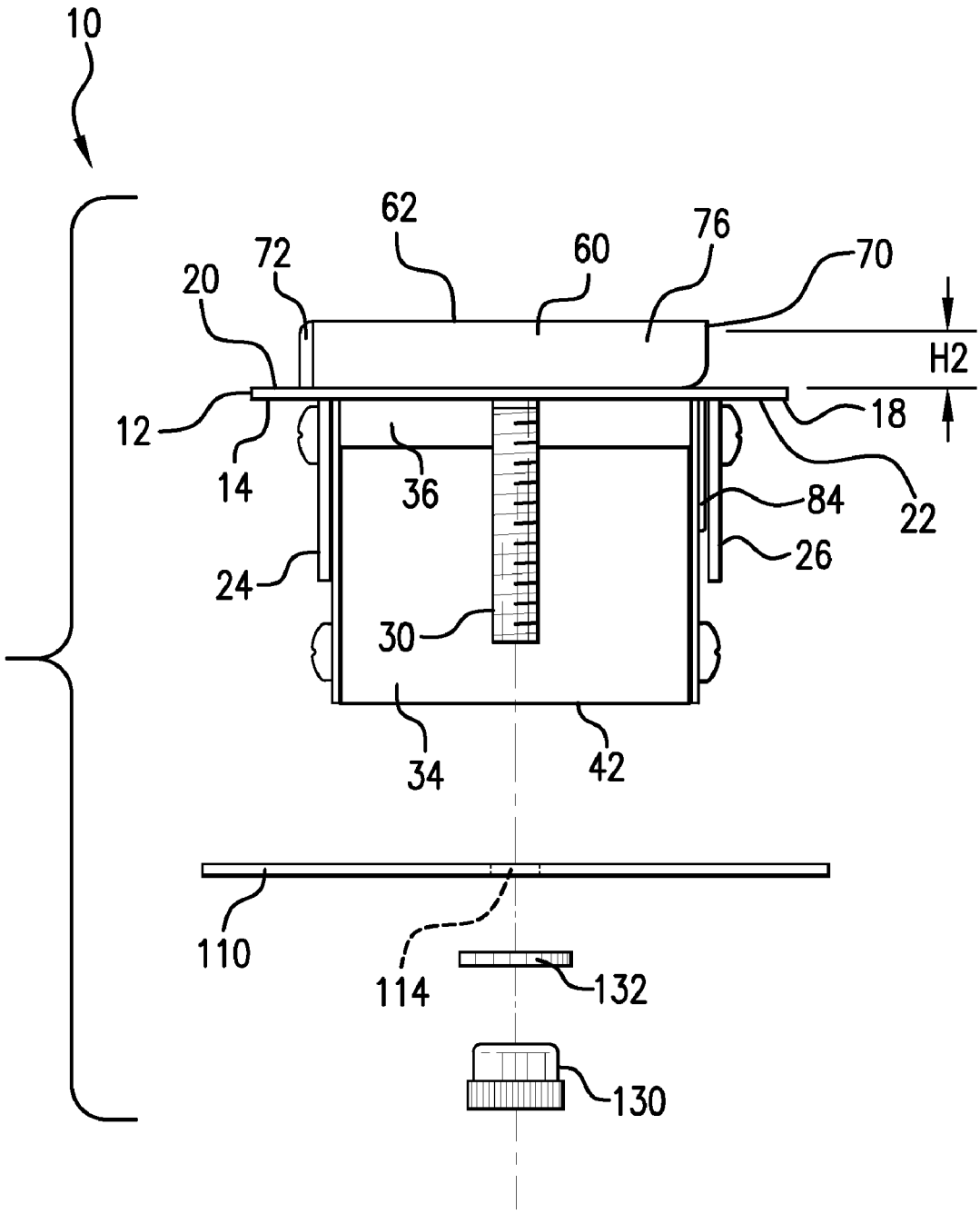
FIG. 5 is a view of the right side of the utility receptacle apparatus of FIG. 1, in elevation, the view of the left side of the utility receptacle apparatus being essentially the same.
Figure 6:
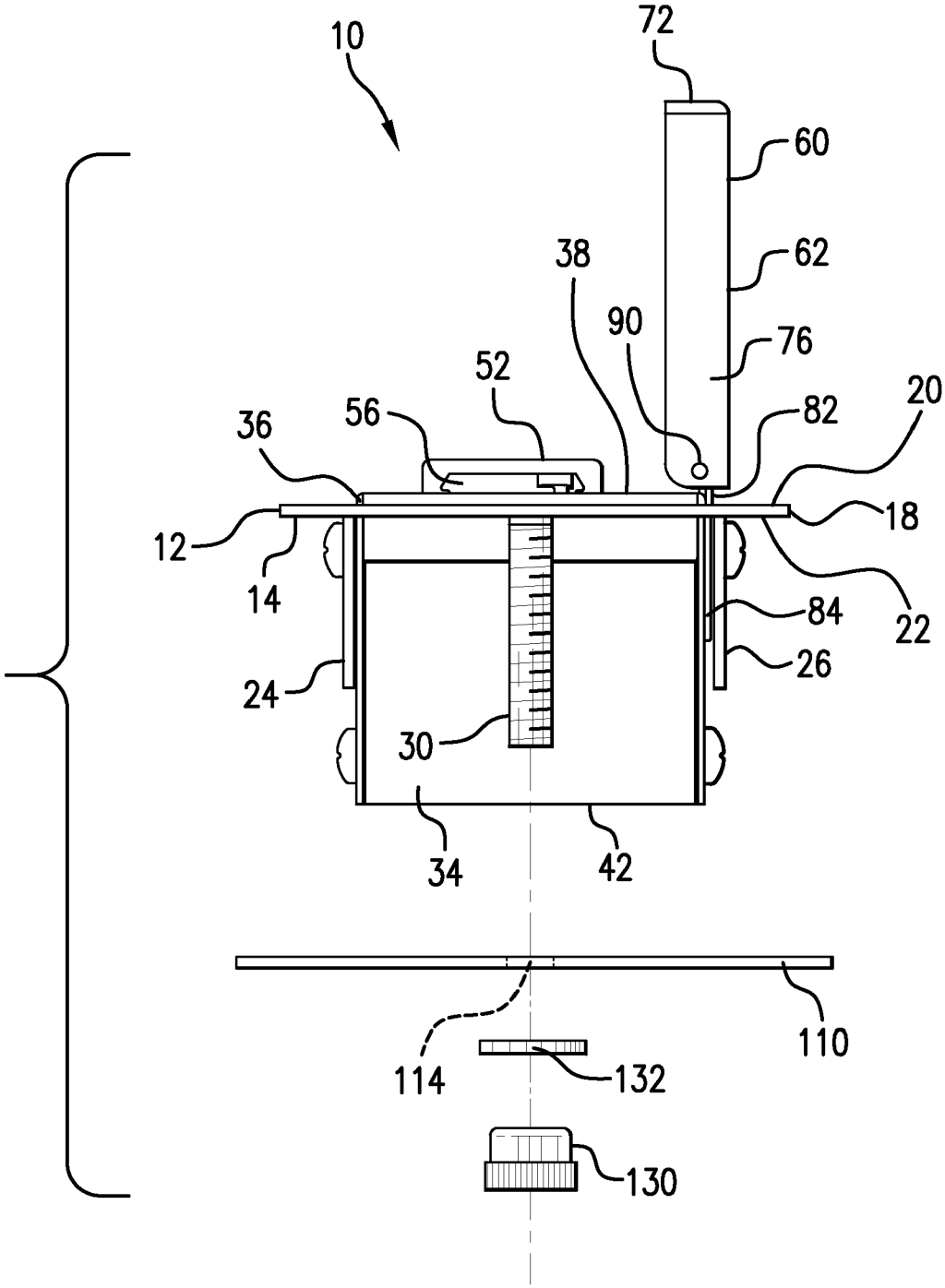
FIG. 6 is a view of the right side of the utility receptacle apparatus, similar to the view of FIG. 5, with the cover of the utility receptacle apparatus in the open position.
Figure 7:
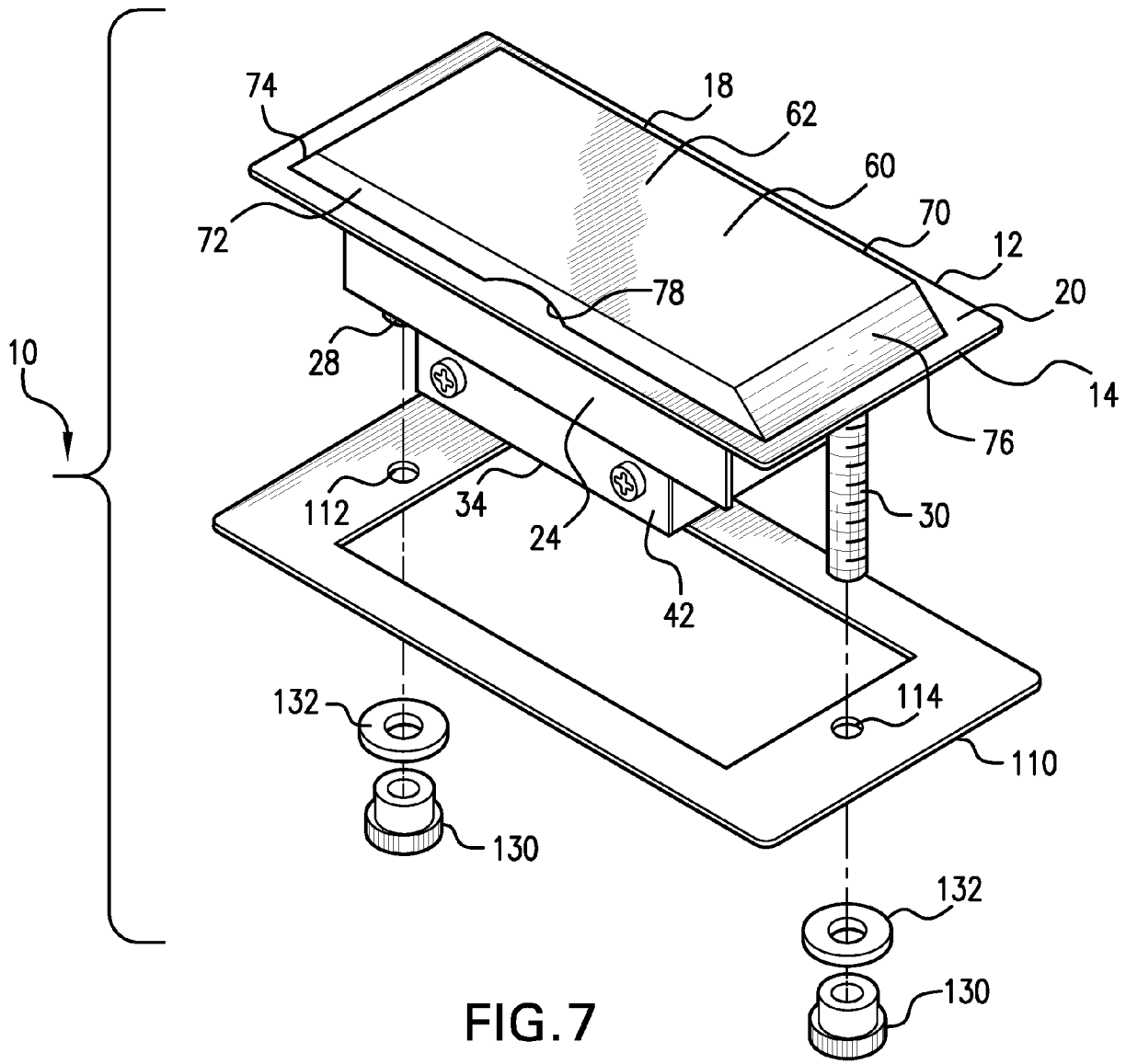
FIG. 7 is an exploded view, in perspective, of the utility receptacle apparatus of FIG. 1.

Referring to FIGS. 5 and 6, utility receptacle apparatus 10 further comprises hinge device 80. In one embodiment, hinge device 80 is configured as a piano-type hinge. Hinge device 80 comprises section 82 that is attached to the cover 60 and section 84 that is attached to the base 34. Section 84 is positioned between base 34 and rear wall 26 of frame 14. Hinge device 80 allows the cover 60 to pivot between a closed position to cover the utility receptacle member 36 and an open position to expose the utility receptacle member 36. Hinge device 80 is configured to position the rear edge 70 of cover 60 at a predetermined height H2 above peripheral portion 18 when cover 60 is closed. The actual height H2 depends upon the height H1. In one embodiment, height H2 is about 10.0 mm and height H1 is about 2.5 mm. Hinge device 80 provides an axis of rotation 90 that is above the top surface 20 of the peripheral portion 18.

Referring to FIGS. 7, 8A, 8B and 8C, utility receptacle apparatus 10 is mounted to an article of furniture 100 such as a work bench, work station, table, desk, etc. Specifically, utility receptacle apparatus 10 is mounted to work surface 101 of the article of furniture 100 and is positioned within opening 102 in work surface 101. Downwardly extending walls 24 and 26 of frame 12 are positioned within opening 102 and bottom surface 22 of peripheral portion 18 contacts the portion 104 of work surface 101 that is adjacent to and extends about opening 102. Screws (i.e. fastener members) 28 and 30 are inserted through corresponding through-holes 106 and 108, respectively, in work surface 101. Utility receptacle apparatus 10 further includes a mounting plate 110 that has through-holes 112 and 114 that receive screws 28 and 30, respectively. Mounting plate 110 is positioned against the bottom surface 120 of the article of furniture 100, and corresponding nuts 130 and washers 132 are engaged to screws 28 and 30, respectively, in order to securely mount utility receptacle apparatus 10 to the article of furniture 100. When utility receptacle apparatus 10 is completely mounted to article of furniture 100 and cover member 60 is opened, utility receptacles 50, 52, 54 and 56 are exposed and accessible to the user.

In a preferred embodiment, frame 14, base 34 and utility receptacle member 36 are fabricated from metal. However, other suitable materials may be used, e.g. plastic, resins, composites, etc.

Figure 9:
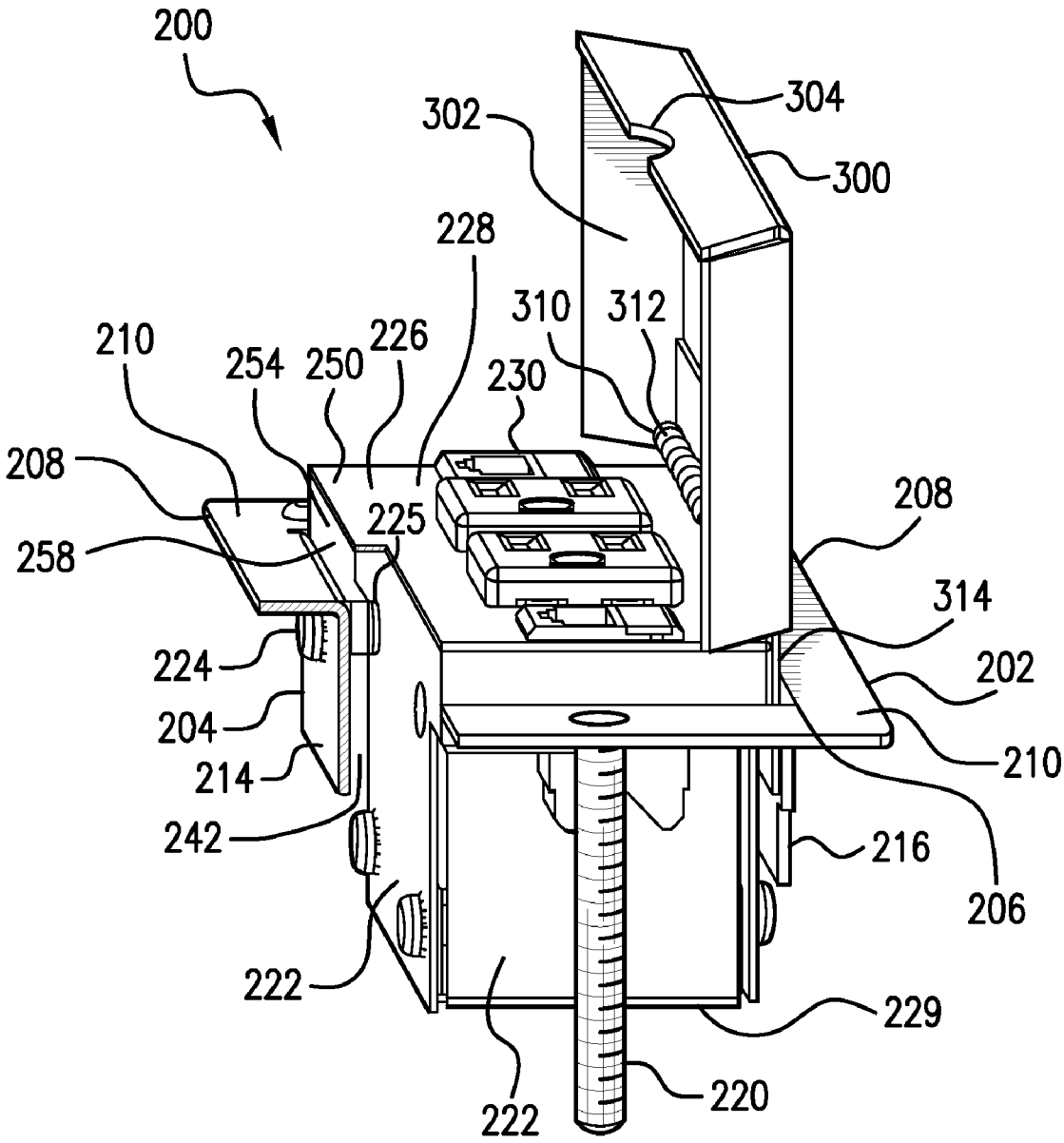
FIG. 9 is a perspective view, partially in cross-section, of a utility receptacle apparatus in accordance with a further embodiment of the present invention.
Figure 10:
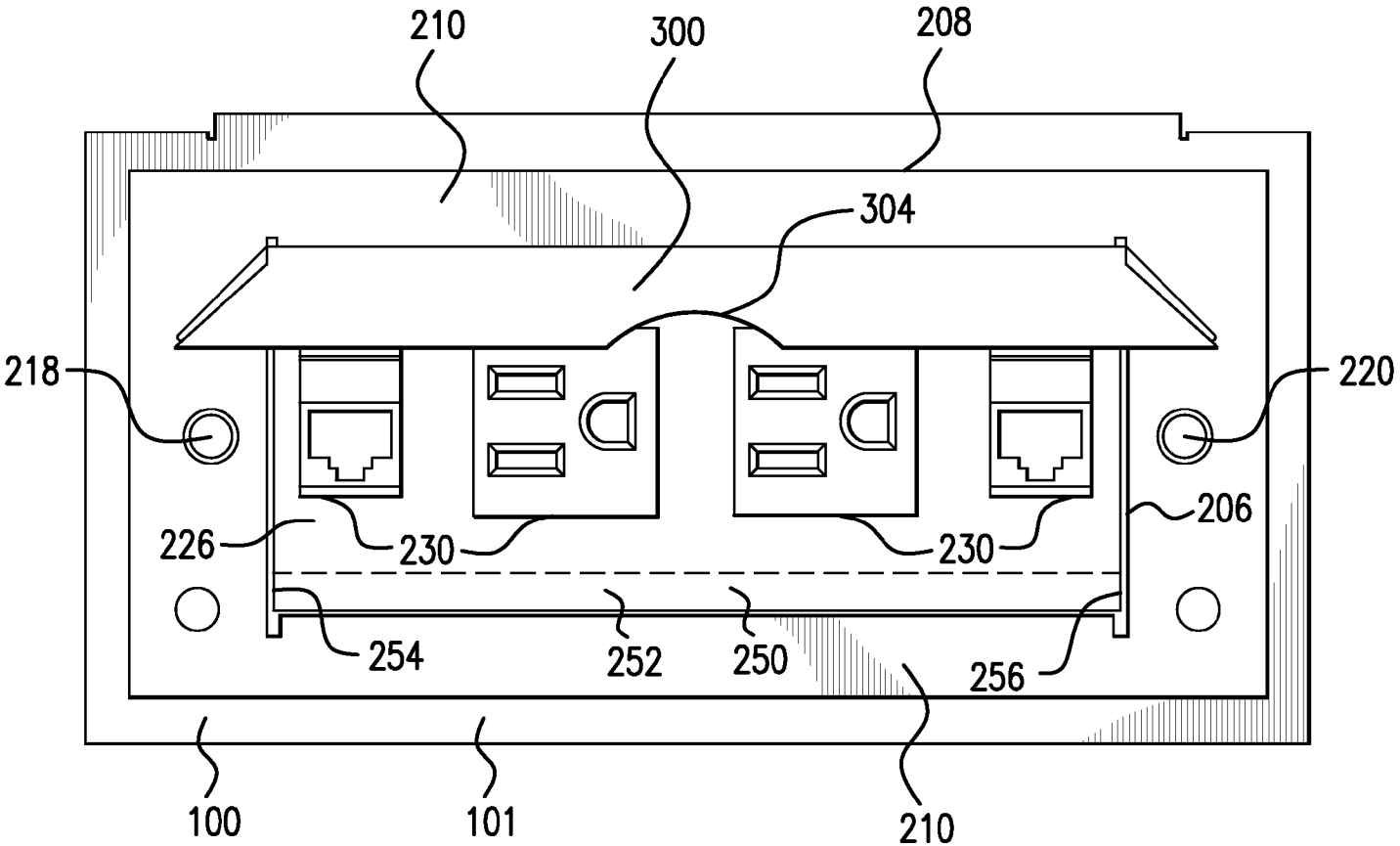
FIG. 10 is a top plan view of the utility receptacle apparatus of FIG. 9.
Figure 11:
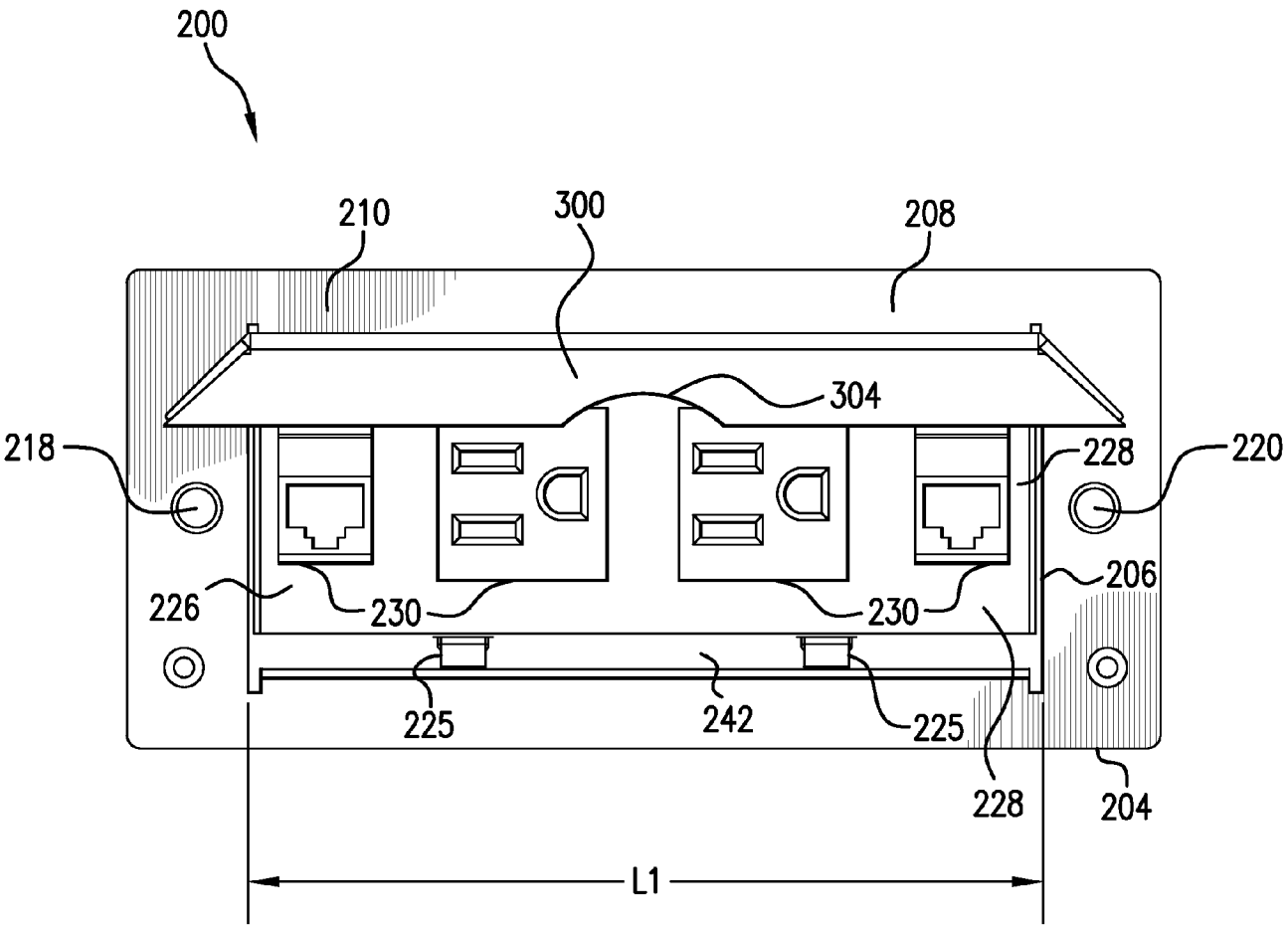
FIG. 11 is a top plan view of the utility receptacle apparatus of FIG. 9, the view being similar to that of FIG. 10 except that a fluid deflector portion is not shown in this view in order to facilitate viewing of a fluid drainage path.
Figure 12:
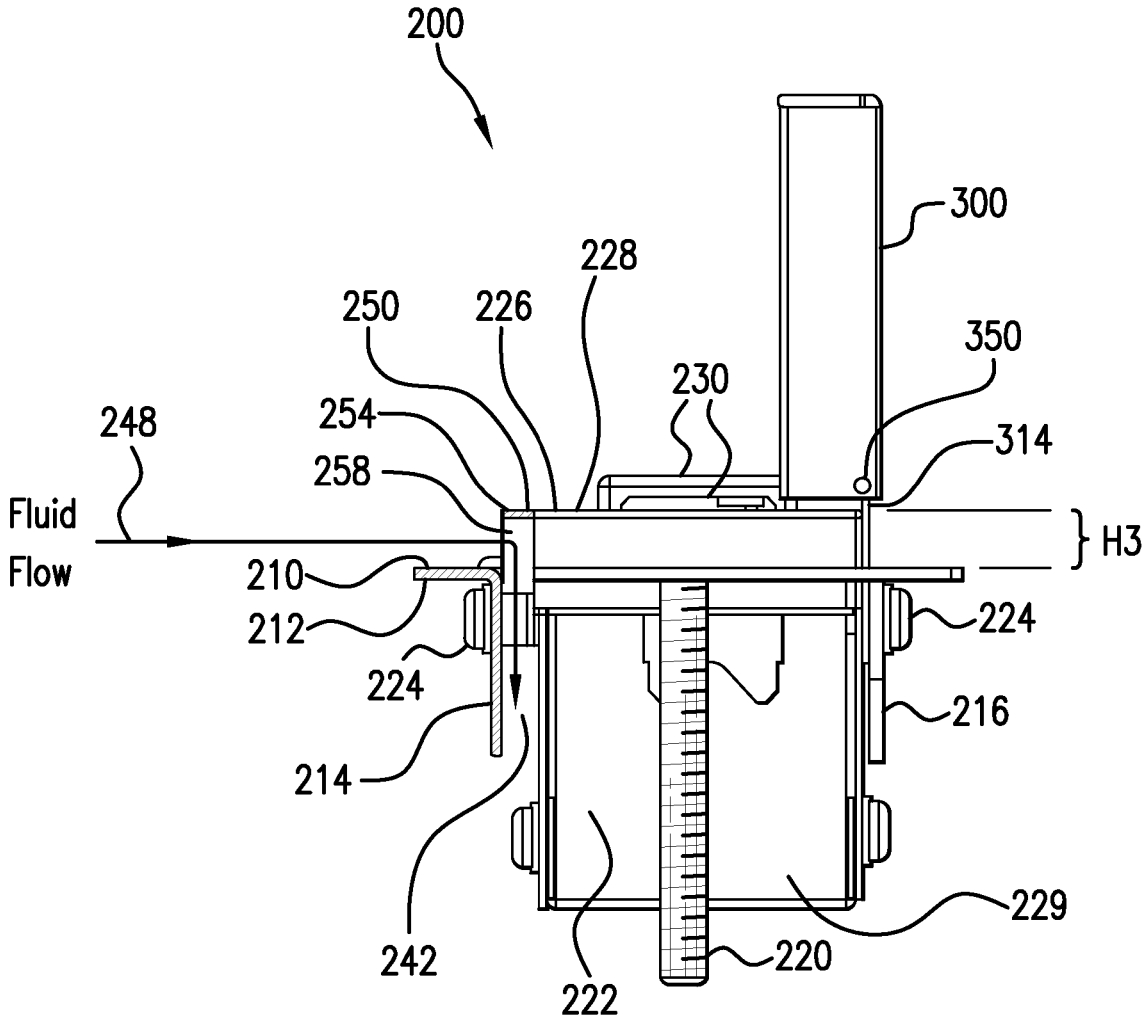
FIG. 12 is a side view, partially in cross-section, of the utility receptacle apparatus of FIG. 9.

Referring to FIGS. 9-12, there is shown utility receptacle apparatus 200 in accordance with another embodiment of the present invention. Utility receptacle apparatus 200 is generally the same in structure as utility receptacle apparatus 10, except that utility receptacle apparatus 200 includes a deflector to prevent water or other fluids from contacting the utility receptacles, and the utility receptacles are positioned at a greater height with respect to the work surface. Utility receptacle apparatus 200 comprises mounting member 202 which comprises a frame 204. Frame 204 has a central opening 206, and a peripheral portion 208 extending about the central opening 206. Peripheral portion 208 has upper or top surface 210 and bottom surface 212. Frame 204 includes downwardly extending front and rear walls 214 and 216, respectively. Mounting member 202 includes fastening members 218 and 220 that have the same function and purpose as fastening members 28 and 30, respectively, of utility receptacle apparatus 10. Apparatus 200 further comprises a base 222 that is attached to the mounting member 202 and positioned within the central opening 206 of the frame 204. In one embodiment, base 222 is removably attached to front and rear walls 214 and 216. Front wall and rear wall 214 and 216, respectively, are attached to base 222 with screws 224. Spacers 225 are mounted on screws 224 and located between front wall 214 and base 222. The purpose of spacers 225 is discussed in the ensuing description. The base 222 comprises a utility receptacle member 226 that has a raised face 228 that is above top surface 210 of peripheral portion 208. The base 222 further comprises a body portion 229 that is attached to and located beneath the utility receptacle member 226. In accordance with this embodiment of the invention, raised face 228 is at least about 6.0 mm (millimeters) above top surface 210 of peripheral portion 208. The height of raised face 228 above top surface 210 is indicated by reference letter H3 in FIG. 12. In a preferred embodiment, raised face 228 is between about 8.0 mm and 10.0 mm above top surface 210. Utility receptacles 230 are connected to raised face 228 in the same manner as utility receptacles 50, 52, 54 and 56 are connected to the raised face 38 of the utility receptacle apparatus 10. As shown in FIGS. 9, 11 and 12, base 222 is spaced apart from front wall 214 of frame 204 by spacers 225. Spacers 225 are mounted on screws 224 that attach front wall 214 to base 222. Spacers 225 provide a space 242 between front wall 214 and base 222. The purpose of space 242 is described in the ensuing description.

Referring to FIGS. 9, 10 and 12, in accordance with this embodiment of the invention, raised face 228 includes a fluid deflector portion 250 that extends outward and over space 242. FIGS. 10 and 11 are both top plan views of utility receptacle apparatus 200. In order to facilitate understanding of this feature of the invention, FIG. 11 purposely does not show fluid deflector portion 250 so space 242 can be viewed. Space 242 functions as a fluid drainage path. In a preferred embodiment, space 242 extends for substantially the entire length L1 of central opening 206 in frame 204. Referring to FIGS. 9, 10 and 12, fluid deflector portion 250 has central portion 252 and side portions 254 and 256. Fluid deflector 250 has an inner surface 258. If fluids are spilled on the work surface and flow over top surface 210 of peripheral portion 208, the fluids splash against the portion of base 222 that is directly under central portion 252 as well as against the inner surfaces 258 of central portion 252, side portion 254 and side portion 256. The fluids will then flow downward through space 242. Reference line 248 in FIG. 12 indicates the flow of fluids over top surface 210 and downward through space 242. As a result, no fluids contact utility receptacles 230. Thus, fluid deflector portion 250 stops fluid from contacting utility receptacles 230 thereby preventing electrical shorting, damage to electronic equipment and injury to users.

Referring to FIG. 9, utility receptacle apparatus 200 further comprises a cover 300. Cover 300 has generally the same structure as cover 30 except that cover 300 is enlarged so as to have larger and deeper spatial region 302 to accommodate the increased height H3 at which raised face 228 is above top surface 210. Cover 300 has a notch or cut-out 304 to enable a user to lift cover 300. Utility receptacle apparatus 200 further comprises hinge device 310 which has generally the same structure and function as hinge device 80 of utility receptacle apparatus 10. Hinge device 310 comprises section 312 that is attached to the cover 300 and section 314 that is attached to the base 222. Section 314 is positioned between base 222 and rear wall 216 of frame 204. Hinge device 310 allows the cover 300 to pivot between a closed position to cover the utility receptacle member 226 and an open position to expose the utility receptacle member 226. Hinge device 310 provides an axis of rotation 350 that is above the upper or top surface 210 of the peripheral portion 208.

It is to be understood that the invention is not limited to the illustrations described and shown herein, which are deemed to be merely illustrative of the best modes of carrying out the invention, and which are susceptible of modification of form, size, arrangement or position of parts, and details of operation. Rather, the invention is intended to encompass all such modifications which are within the spirit and scope as defined by the claims.

What is claimed is:

1. A utility receptacle apparatus for use with a work surface, comprising:

a mounting member comprising a frame having a central opening and an peripheral portion extending about the central opening;

at least one fastening device attached to the mounting member for attaching the mounting member to a work surface;

a base positioned within the central opening of the frame and attached to the frame, the base comprising a body portion and utility receptacle member attached to the body portion, the utility receptacle member having a raised face that extends above the peripheral portion of the frame;

at least one utility receptacle connected to the raised face of the utility receptacle member;

a hinge device having a first section attached to the base and a second section that pivots with respect to the first section; and a cover attached to the second section of the hinge device so that the cover pivots between a closed position to cover the utility receptacle member and an open position that exposes the utility receptacle member, the cover comprising a front portion, a pair of side portions, an exterior portion and an interior portion, the interior portion comprising a recessed interior surface that confronts the raised face of the utility receptacle member when the cover is in the closed position, the front and side portions of the cover and the recessed interior surface of the cover cooperating to provide a spatial region within the interior portion of the cover that is sized to receive the entire raised face of the utility receptacle member.

2. The utility receptacle apparatus according to claim 1 wherein the hinge device is configured as a piano-type hinge.

3. The utility receptacle apparatus according to claim 1 wherein the peripheral portion has an upper surface and a bottom surface.

4. The utility receptacle apparatus according to claim 3 wherein the axis of rotation of the cover is above the upper surface of the peripheral portion.

5. The utility receptacle apparatus according to claim 3 wherein the frame comprises front and rear walls that extend downward from the bottom surface of the peripheral portion, the front and rear walls being on opposite sides of the central opening, the front and rear walls being sized to fit within an opening in a work surface of an article of furniture.

6. The utility receptacle apparatus according to claim 5 wherein the front and rear walls are substantially perpendicular to the bottom surface of the peripheral portion of the frame.

7. The utility receptacle apparatus according to claim 1 wherein the front portion of the cover comprises a front lengthwise end that is angulated with respect to the recessed interior surface.

8. The utility receptacle apparatus according to claim 7 wherein each side portion of the cover is bevelled and wherein the bevelled side portions and the front lengthwise end cooperate to provide the spatial region within the interior portion of the cover.

9. The utility receptacle apparatus according to claim 3 wherein the raised face is between about 2.0 and 4.0 mm above the upper surface of the peripheral portion of the frame.

10. The utility receptacle apparatus according to claim 3 wherein the raised face is greater than 4.0 mm above the upper surface of the peripheral portion of the frame.

11. The utility receptacle apparatus according to claim 1 wherein the hinge device is configured so that the rear edge of the cover is about 10.0 mm above the upper surface of the peripheral portion when the cover is closed.

12. The utility receptacle apparatus according to claim 1 further including a deflector portion contiguous with the raised face to prevent fluids from contacting the utility receptacles.

13. The utility receptacle apparatus according to claim 1 further including means for preventing fluids from contacting the utility receptacles.

* * * * *